US006851376B2

(12) United States Patent
D'Agostino

(10) Patent No.: US 6,851,376 B2
(45) Date of Patent: Feb. 8, 2005

(54) PULL DOWN SHELF FOR OVERHEAD STORAGE

(76) Inventor: James D'Agostino, 715 Scott Ave., Syracuse, NY (US) 13224

( * ) Notice: Subject to any disclaimer, the term of this patent is extended or adjusted under 35 U.S.C. 154(b) by 136 days.

(21) Appl. No.: 10/331,385

(22) Filed: Dec. 30, 2002

(65) Prior Publication Data

US 2004/0123781 A1 Jul. 1, 2004

(51) Int. Cl.[7] ..... A47B 37/00

(52) U.S. Cl. ..... 108/42; 108/20; 108/147; 108/149; 248/330.1

(58) Field of Search ..... 312/247, 246, 312/319.3, 319.1, 319.7; 108/42, 20, 114.11, 145, 146–147, 149; 248/277.1, 321, 330.1, 323, 343

(56) References Cited

U.S. PATENT DOCUMENTS

| | | | | | |
|---|---|---|---|---|---|
| 982,056 | A | * | 1/1911 | Hammell | 62/260 |
| 1,964,339 | A | * | 6/1934 | Brassell | 312/247 |
| 2,435,755 | A | * | 2/1948 | Schimpff | 248/277.1 |
| 2,592,760 | A | * | 4/1952 | Sutera | 312/247 |
| 3,829,912 | A | | 8/1974 | Quackenbrush | |
| 4,669,773 | A | | 6/1987 | LeVee | |
| 4,830,147 | A | * | 5/1989 | Kawada | 248/277.1 |
| 5,203,619 | A | * | 4/1993 | Welsch et al. | 312/247 |
| 5,261,645 | A | | 11/1993 | Huffman | |
| 5,366,203 | A | * | 11/1994 | Huffman | 248/277.1 |
| 5,379,977 | A | * | 1/1995 | Ronn et al. | 248/277.1 |
| 5,475,949 | A | | 12/1995 | McCoy | |
| 6,073,892 | A | * | 6/2000 | Dittmer | 248/327 |
| 6,250,728 | B1 | | 6/2001 | Thorp | |
| 6,345,799 | B1 | * | 2/2002 | Fusi | 248/277.1 |
| 6,484,993 | B2 | * | 11/2002 | Huffman | 248/323 |
| 6,637,711 | B2 | * | 10/2003 | Enochs | 248/277.1 |

FOREIGN PATENT DOCUMENTS

| | | | | |
|---|---|---|---|---|
| GB | 2223670 | * | 4/1990 | 312/247 |
| JP | 05228034 | * | 9/1993 | 312/247 |

* cited by examiner

*Primary Examiner*—Lanna Mai
*Assistant Examiner*—Hanh V. Tran
(74) *Attorney, Agent, or Firm*—Bernhard P. Molldrem, Jr.

(57) ABSTRACT

A pull-down shelf for storage of articles has a lower shelf portion that contains a wind-up mechanism, which can be spring powered or motorized, an overhead mounting plate that attaches to ceiling joists or the like, and at least a pair of cables that are wound onto arbors of the wind-up mechanism for suspending the shelf portion from the overhead mounting plate. Scissors-action stabilizers hold the shelf from tipping or swinging. The user pulls the shelf down, and this unwinds the cables and charges the springs. A releasable ratchet wheel keeps the mechanism from turning in the rewind direction. The user can pull or actuate a release handle or button to release the shelf and let the spring rewind the cables to pull the shelf back to its overhead position.

14 Claims, 4 Drawing Sheets

PULL DOWN SHELF FOR OVERHEAD STORAGE

BACKGROUND OF THE INVENTION

This invention relates to storage and work shelf devices for out-of-the-way storage of items, and is more particularly concerned with shelf arrangements that permit overhead storage, e.g., in a garage of other structure, which can be raised overhead when not in use and can be lowered for use, i.e., by pulling the shelf down to a lowered, working position.

Shelves are often and commonly used for storing items, such as clothing, towels, gardening equipment, tools, cleaning compounds, or other items. However, in order to be useful the shelf has to be low enough to allow access to frequently used items, but high enough to allow the space beneath the shelf to be utilized. In living areas shelves are commonly installed in the top of a closet or above counters, workbenches or desks. In other areas, such as garages and basements, shelves are placed higher on walls, or hung from ceilings to allow better use of the space underneath them. This space is often required for workshop tools, lawn mowers, snow blowers, or other equipment, or simply to allow room to open the garage door. Garage shelves must generally be mounted high enough to allow room to walk underneath, thus requiring a stepladder or step stool for access to items stored on the shelf. Because of the inconvenience of the higher shelf, only less frequently used items are stored there. More frequently used items tend to be placed in floor level cabinets or simply left on the floor, thus taking up the very floor space that the overhead shelf was intended to save.

A number of disappearing cabinets and shelves have been proposed in the art. For example, LaVee U.S. Pat. No. 4,669,773 is directed to a storage pod for overhead storage in the roof of a vehicle, and employs lazy tong linkages and counterbalance coil springs. Quackenbrush U.S. Pat. No. 3,829,912 relates to a bed assembly that retracts into an overhead space. Huffman U.S. Pat. No. 5,261,645 concerns a remotely controlled lifting shelf for supporting a video projection machine, and has a motorized cable system to draw the support shelf and video projector up into a recess in the ceiling. McCoy U.S. Pat. No. 5,475,949 is concerned with a closet that is supported overhead in an enclosure that fits into the ceiling joists, in which the closet can be pulled down for use, and retracts by spring action into the enclosure in the ceiling. Thorp U.S. Pat. No. 6,250,728 relates to a similar hanging closet arrangement, but one in which a torsion spring provides the power to wind a cable onto a pulley and pull the closet up into the overhead housing. None of these prior arrangements would be suitable for a storage shelf for a garage or basement, for example, in which the shelf could be simply pulled down to a lowered position for use and could be released to be raised to an overhead storage position.

OBJECTS AND SUMMARY OF THE INVENTION

Accordingly, it is an object of this invention to provide an overhead storage shelf that can be easily lowered for access to the articles on the shelf, and which avoids the drawbacks of the prior art.

It is a more specific object to provide a storage shelf that allows the stored items to be kept at a space just below the ceiling of the garage, basement, or other structure, which is convenient to lower for use, and return easily to the upward or raised storage position.

It is another feature to provide a shelf that can be moved vertically, and in which the mechanism for raising or lowering the shelf is situated in the movable shelf rather than in the overhead support.

In accordance with an aspect of this invention, a pull-down storage or work shelf arrangement has an overhead mounting plate that attaches either to ceiling joist or to vertical wall studs at an overhead position, and a vertically movable storage shelf. The shelf has an upper platform, and may have a base member beneath it. A spring-loaded wind-up mechanism mounted on it, or within the shelf portion of the assembly. The wind-up mechanism has a pair of arbors that are driven to rotate by a spring. A ratchet wheel or cam on the shaft for the arbors releasably locks the arbors against rotation in a rewind direction. Typically, this involves a pawl mechanism with a lever that is spring biased towards the ratchet wheel and a tooth that engages the ratchet teeth, and a release cord (or button) that is actuated to release the pawl from the ratchet. There are first and second cables wound onto the two arbors, respectively, and these extend upward such that the upper ends of the cables attach to anchor points on the mounting plate. In order to stabilize the shelf against tipping, twisting, or swinging, there are first and second scissors-action stabilizer linkages mounted at the left and right ends of the shelf and also at the left and right ends of overhead mounting plate.

When the user needs access to the articles on the shelf, the user pulls down on the shelf to lower it from a raised position thereof to a lowered position. There may be a cord or handle on the bottom or base of the shelf for this purpose. When the shelf descends, the cables unwind from the arbors of the wind-up mechanism and this charges the spring. The ratchet mechanism engages and locks the wind-up mechanism from rotation in the rewind direction, so that the shelf remains in its lowered position. The scissors-action stabilizer linkages stabilize the shelf. When the user if finished with the articles on the shelf, he or she simply actuates the release mechanism on the ratchet mechanism, i.e., by pulling on a release cord or pressing a release button, and the wind-up mechanism rewinds the cables back onto said arbors to lift the shelf to its raised position.

By having the motive element, that is the wind-up mechanism, located within the lower shelf rather that in the fixed overhead support element, the user has better positive control over positioning the shelf when it is lowered, and in releasing the shelf to let it ascend to its storage position.

In one favorable embodiment, the wind-up mechanism includes a rod or shaft that is journalled to either the base or the platform of the shelf. The arbors can be formed at ends of the rod. The spring can be a torsion spring that is disposed over the rod between the two arbors.

An adjustable guard railing can extend around the periphery of shelf platform so that items do not slide or fall off the shelf.

In a favorable embodiment, the overhead mounting plate has an L-shaped profile to permit mounting on either of an overhead horizontal support member (such as ceiling joists) or a vertical support member (such as vertical wall studs).

The scissors-action stabilizer linkages are formed of a number of elongated slat members that are each joined by low friction pivots at their center to a center of another of the slat members, and are also pivoted at their ends to an end of another of the slat members.

Another embodiment of a raiseable and lowerable storage or work shelf arrangement can involve the same structure as in the embodiment just mentioned, except having a motorized wind-up mechanism mounted on the shelf (or within the shelf) and in which the pair of arbors rotate under action of a motor, e.g., an electric gear motor. In this embodiment, the user actuates the motor to lower the shelf from its raised position to a lowered position. The motor rotates the cables in an unwind direction, and the cables unwind from the arbors. A locking mechanism locks the wind-up mechanism against rotation with the shelf in its lowered position. As with the first embodiment, the scissors-action stabilizer linkages stabilize the shelf against tipping, twisting, or swinging. When the user actuates a control for the motor to raise the shelf, a release mechanism releases the wind-up mechanism, and the latter rewinds the cables onto the arbors to lift the shelf to its raised position.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
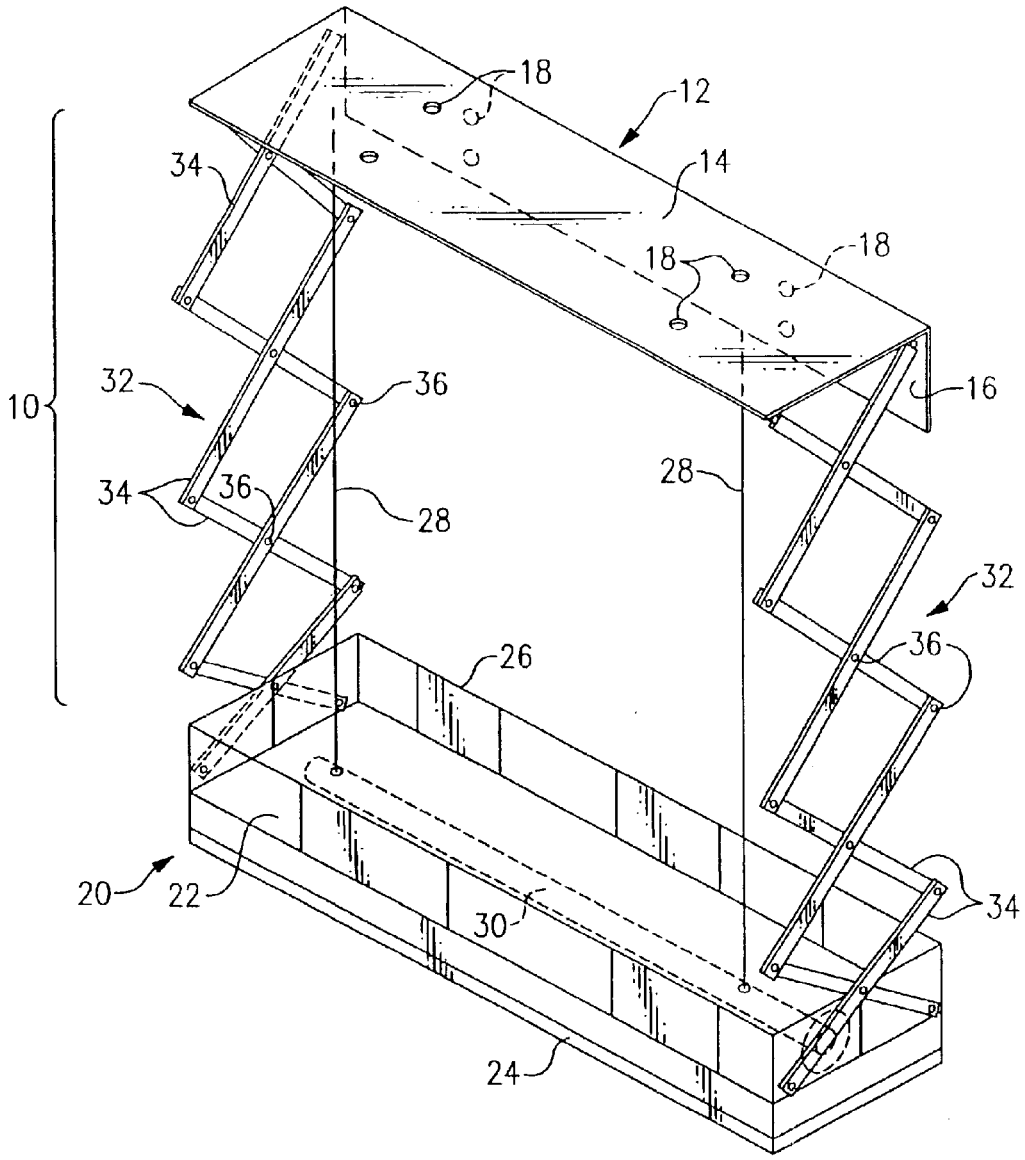
FIG. 1 is a schematic perspective view of a pull-down shelf arrangement, according to one possible embodiment of this invention.

With reference to the Drawing, and initially to FIG. 1, a pull-down shelf assembly 10 is provided to allow items to be stored, e.g., just below the ceiling or overhead joists of a garage, basement, or other area, where the space would be otherwise unusable or inaccessible. The shelf arrangement 10 has an overhead mounting plate 12, which in this embodiment has an angled or L-shaped profile, with a horizontal upper or top plate 14 and a vertical back plate 16. The top plate and back plate are provided with mounting holes 18, spaced so as to match the positions of ceiling joists or vertical wall studs. A shelf 20 is suspended below the mounting plate 12, and in this embodiment is formed of an upper platform 22 and a lower base plate 24. Here, the shelf is in the form of a box of which the platform and base plate form the top and bottom. A peripheral railing 26 is provided on the platform 22 to retain items that are placed on the shelf. A pair of cables 28 extend from the shelf 20 up to anchor points in the mounting plate 12, and a spring powered wind-up mechanism 30 within the shelf 20 operates to play out the cable or to rewind it to lower and raise the shelf 20. This wind-up mechanism will be discussed in detail shortly.

Right and left side scissors-action stabilizers 32 are connected to right and left ends, respectively, of the overhead mounting plate 12 and to right and left ends of the shelf 20. Each of the stabilizers 32 is formed of a number of elongated slats or arms 34, which are pivotally connected to one another in a criss-cross fashion. There are pivot members 36 joining each of the arms 34 to another arm 34 at ends and at the centers, as shown. The action and construction of these scissors-action stabilizers is well known in this field. The stabilizers ensure that the shelf 20 is kept level, that is, so that is does not tip, swing, or twist, while it is being raised or lowered.

Figure 2:
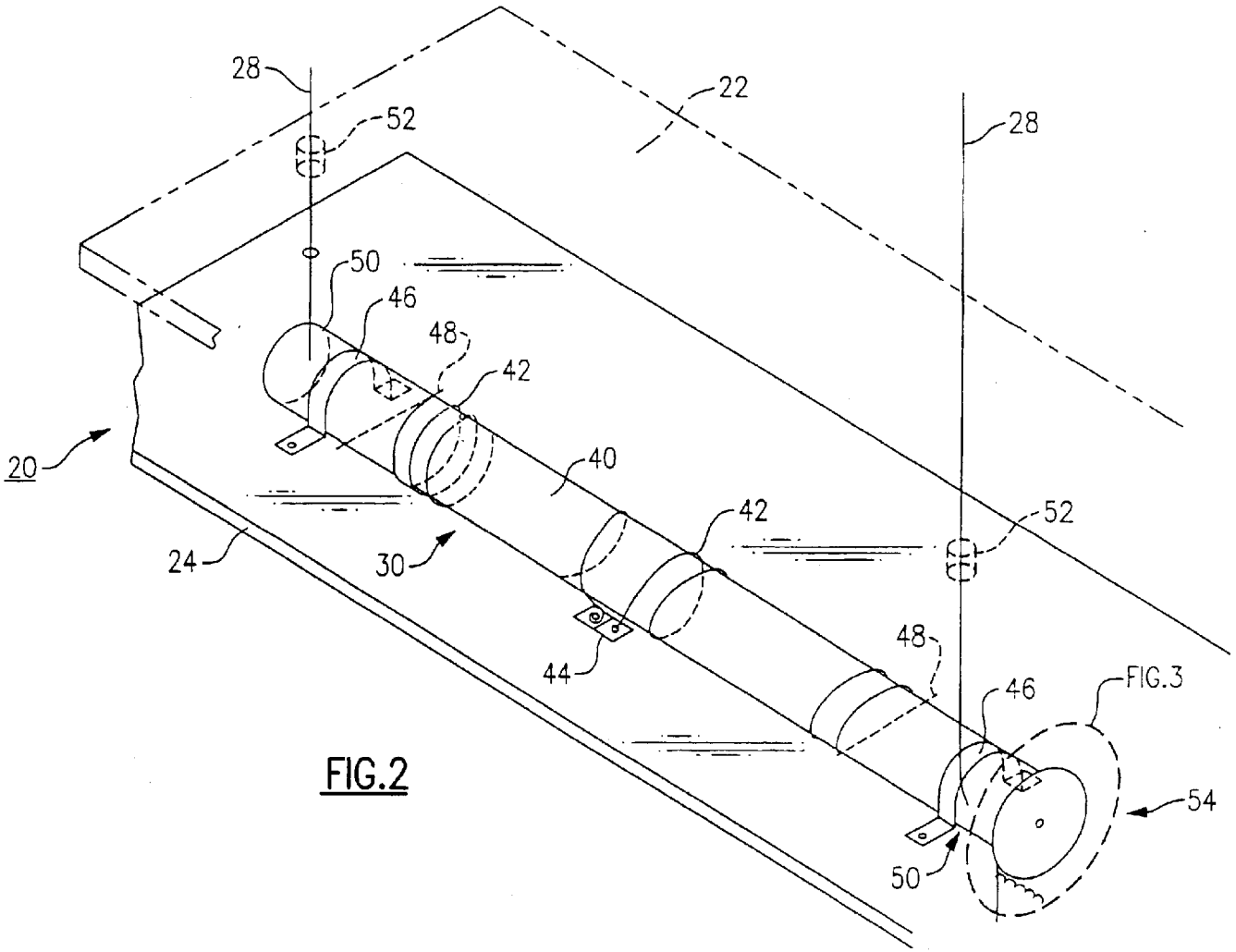
FIG. 2 is schematic partial perspective of the shelf portion of this embodiment.

The spring-loaded or spring-powered wind-up mechanism 30 is shown in FIG. 2. A horizontal rod or shaft 40 has a torsion spring or springs 42 mounted over it, with a spring anchor on the base plate 24. There are bearings or journals 44 attached to the base plate that permit rotation of the shaft 40, and pin(s) or bar(s) for holding the outer end(s) of the spring 42 fast to the shaft 40. The cables 28 are wound onto arbors 50 that are formed at the left and right ends of the shaft 40, and which may be formed either as a portion of the shaft or as separate members operatively coupled to rotate with the shaft. In operation, the spring force acts to wind the cables 28 onto the arbors 50, and the withdrawal of the cables 28 turns the shaft 40 in the direction to charge the spring or springs 42. There are a pair of sleeves 52, which may be constituted of a low-friction tubular material, or may include a lubricant material, fitted into the shelf platform 22, and through which the two cables 28 pass. An anti-rotation mechanism 54 on the shaft 40 prevents the wind-up mechanism 30 from rotating the shaft 40 and arbors 50 in the re-wind direction until the user releases a catch or pawl, so the shelf remains in the lowered position until the user affirmatively releases it.

Figure 3:
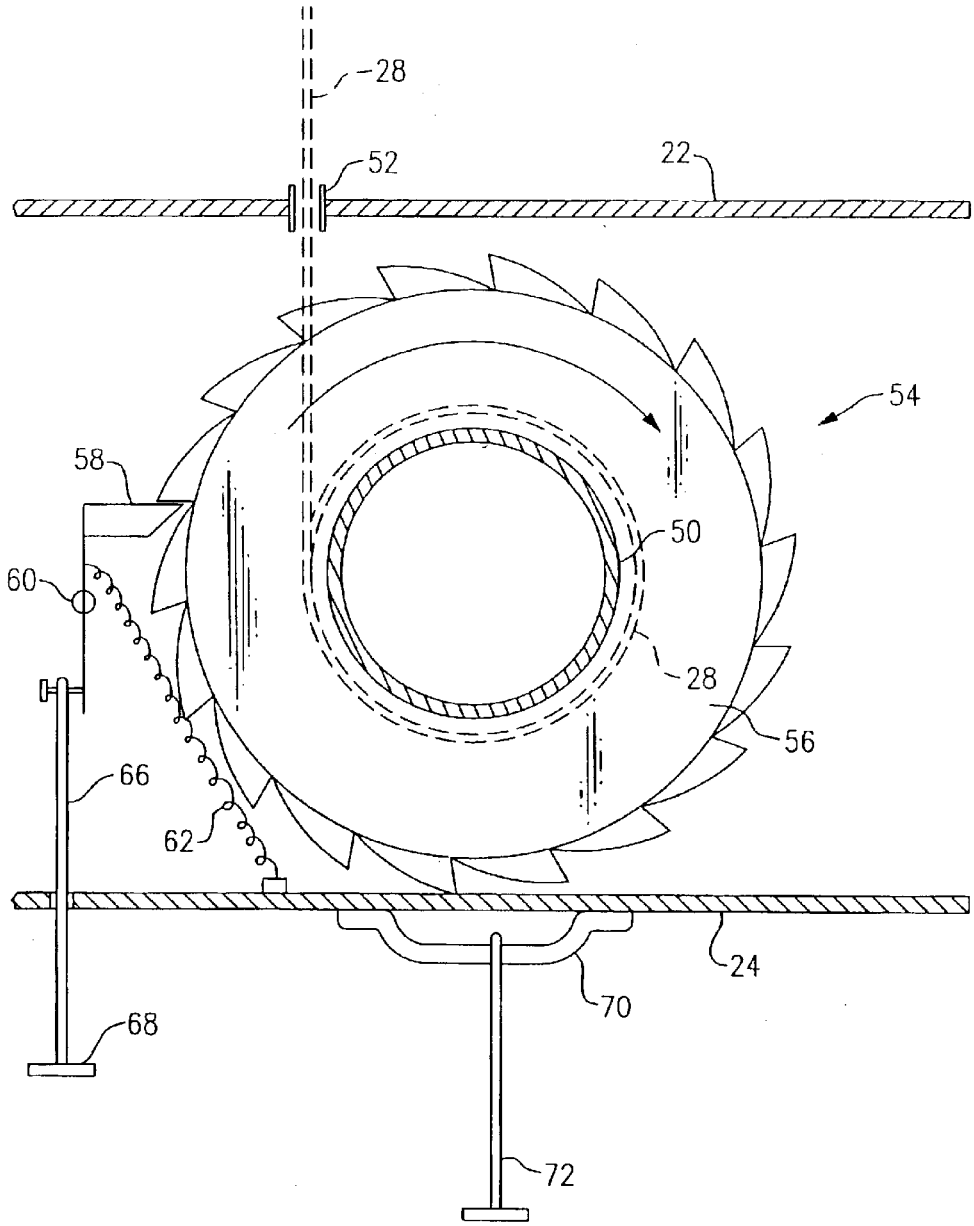
FIG. 3 is a sectional elevation of the shelf portion of this embodiment.

As shown in FIG. 3, the anti-rotation mechanism 54 can take the form of a toothed ratchet wheel or cam 56 with a pawl or locking lever 58. The ratchet wheel 56 is mounted coaxially with the shaft 40 and arbors 50. The arrow indicates the direction of rotation when the shelf is pulled down, i.e., when the cable 28 pays out, to charge the spring 42. The pawl or locking lever 58 is mounted on a pivot 60 and is biased by a spring 62 into engagement with the teeth on the ratchet wheel 56. In this embodiment, there is a release cord 66 attached to the lever 58 with a handle 68. The user can pull the cord 66 and handle 68 to release the anti-rotation mechanism 54 so that the shelf can be returned to its upper, or storage position near the mounting plate 12.

Attached onto the bottom of the base plate 24 are one or more handles 70 which the user may use to pull the shelf 20 down from its overhead position to its lowered position. A rope pull 72 may also be used, for initially lowering the shelf when the shelf is high overhead.

Figure 4:
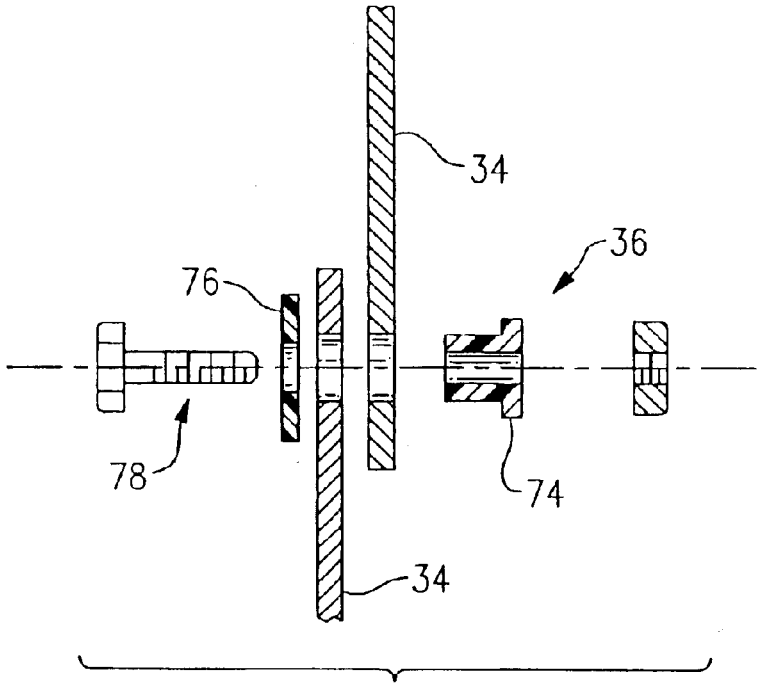
FIG. 4 is an assembly view of the pivot portion of the scissors action stabilizer of this embodiment.

The pivot members 36 for the scissors-action stabilizers 32 may incorporate the general structure that is shown in FIG. 4. Here, for each pivot point between two slats or arms 34 there is a law-friction plastic sleeve 74 which fits into respective pivot openings in the two arms 34. This sleeve may be made of a synthetic material. e.g. a durable plastic with a lubricant filler. A low-friction washer 76 may be placed at one side, and a suitable fastener 78 is fitted through the sleeve 74 and washer 76. In this embodiment, the fastener may be constituted by a bolt and nut.

When the user wants to access items stored on the shelf 20, he or she pulls it down, using the rope pull 72 and handle(s) 70. The lowering of the shelf 20 pays out the cables 28, and they rotate the shaft as they unwind from the arbors, thus charging the spring 42. The ratchet mechanism 54 prevents the spring 42 from recoiling, and holds the shelf 20 at the desired height. When the items have been placed on the shelf 20 or retrieved from it, the user can release the ratchet mechanism by pulling on the release cord 66, allowing the cable to rewind and pull the shelf 20 back up to its overhead storage position. The adjustable railing 26 prevents items from falling off the shelf during raising or lowering.

The mounting plate 12 can be made of metal, wood, fiberglass, or a suitable plastic. The shelf 20 can be made of wood, metal, fiberglass or other strong material. In this embodiment, the shelf 20 is of hollow construction, with the wind-up mechanism contained inside it. In other possible embodiments, there may be a cover over the wind-up mechanism, either on top of or beneath the platform. If the preferred box construction is followed, the sides of the shelf between the base and platform portions may be made of a pegboard material or other perforated material, so that tools or other items may be suspended from the sides in pegboard fashion.

The retracting cables may be any suitable cable material, preferably a coated flexible material such as steel, aluminum or nylon. The rod or shaft 40 may favorably be about one-inch in diameter, with the spring 42 having a sufficient open core to fit over this rod. The rod or shaft may be of metal or of any suitable material e.g., reinforced fiberglass, that can hold up after repeated use.

The shelf assembly of this invention can have a wide variety of applications outside of garage or basement storage. The shelf can be given a finished decor, and used in an office environment, e.g., disappearing into a false or suspended ceiling. The shelf can have file cabinet drawers mounted on it to create additional office filing space. An electric outlet may be added to use small appliances such as a coffee maker or a microwave oven. Additional shelves may be attached to make a multi-tiered configuration.

Preferably, the shelf has three handles 70, and each may have its own rope pull 72 attached. The rope pulls can be adjusted to various heights to prevent smaller children from being able to access the shelf.

Figure 5:
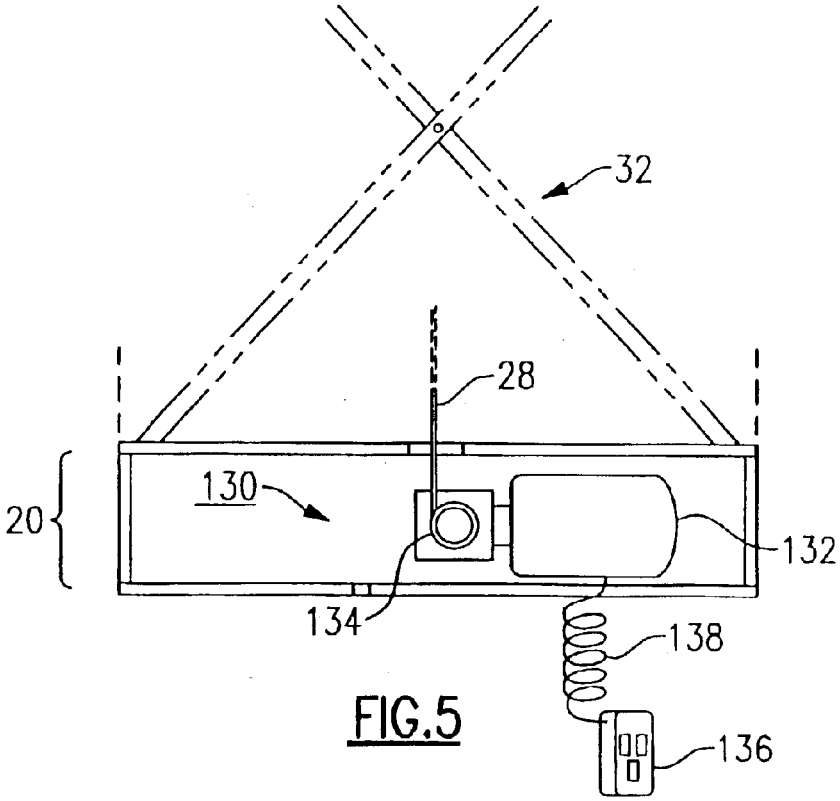
FIG. 5 is a schematic elevation for explaining another embodiment.

An alternative embodiment is shown, in pertinent part, in FIG. 5. Here, the parts that are identical with the first embodiment are identified with the same reference characters, or are omitted from this view. The shelf 20, the cables 28 and the side scissors-action stabilizers 32 can be of the same general construction as discussed above. However, in place of the spring-action wind-up mechanism of the previous embodiment, this embodiment employs a motorized wind-up mechanism 130 situated in the shelf 20. The wind-up mechanism 130 is constituted by an electric motor 132, plus gears and a worm drive coupled to rotate the arbors 134 on which the cables 28 are wound. A hand-actuated power controller 136 is shown here hanging down from the shelf 20 and coupled to the motor by means of a coiled cord 138. The electric power for the motor maybe provided via a power cord that passes down from the overhead mounting plate to the shelf. In this embodiment, the wind-up mechanism 130 favorably includes a brake or other anti-rotation mechanism provided with a release mechanism, so that the shelf remains stable in its raised and lowered positions. Having the motorized wind-up mechanism 130 and its controls located in the lower shelf portion rather than overhead in the mounting plate provides advantages in operation as was the case in the earlier-described embodiment.

Many other modifications and variations are possible which would not depart from the scope and spirit of this invention, as defined in the appended claims.

I claim:

1. A pull-down storage or work shelf arrangement comprising:

an overhead mounting plate adapted to be attached onto an overhead structural support;

a shelf having a spring-loaded wind-up mechanism mounted thereon, the shelf including an upper platform, the wind-up mechanism being situated in an enclosed space on said shelf and having a pair of arbors which rotate under action of a spring and a ratchet mechanism releasably locking said arbors against rotation in a rewind direction;

first and second cables wound onto said arbors respectively and extending upwards to said mounting plate; and first and second scissors-action stabilizer linkages mounted respectively at left and right ends of said shelf and also at left and right ends of said overhead mounting plate; and wherein said shelf arrangement is adapted to operate such that when a user pulls down on said shelf to pull it down from a raised position thereof to a lowered position, the cables unwind from said arbors of said wind-up mechanism and charge the spring thereof, said ratchet mechanism locks said wind-up mechanism against rotation in the rewind direction with the shelf in its lowered position, and said scissors-action stabilizer linkages stabilize said shelf against tipping and swinging; and when the user actuates a release mechanism on said ratchet mechanism, said wind-up mechanism rewinds said cables onto said arbors to lift said shelf to its raised position.

2. A shelf arrangement according to claim 1 wherein said wind-up mechanism includes a rod that is journalled to said shelf beneath said platform, with said arbors being formed at ends of said rod and said spring being disposed over said rod between said arbors.

3. A shelf arrangement according to claim 2 wherein said ratchet includes a toothed ratchet wheel connected with an end of said rod and a pawl having a lever and tooth, and biased into engagement with said ratchet wheel.

4. A shelf arrangement according to claim 3 further comprising a hand operated control below a base of said shelf for releasing the pawl from engagement with said ratchet wheel.

5. A shelf arrangement according to claim 1 further comprising an adjustable guard railing disposed at a periphery of said shelf.

6. A shelf arrangement according to claim 1 wherein said overhead mounting plate has an L-shaped profile to permit mounting on either of an overhead horizontal support member or a vertical support member.

7. A shelf arrangement according to claim 1 wherein each said scissors-action stabilizer linkages includes a plurality of pair of elongated slat members that are each joined by pivot means at their center to a center of another of the slat members, and are joined by pivot means on at least one end to an end of another of said slat members.

8. A shelf arrangement according to claim 7 wherein said pivot means includes a plurality of low-friction synthetic bushings passing through pivot openings in the associated slat members.

9. A shelf arrangement according to claim 1 wherein said shelf includes a lower base plate, the platform member and base plate forming a box structure, with the wind-up mechanism being contained in said box structure below said base plate and said platform member.

10. A raisable and lowerable storage or work shelf arrangement comprising:

an overhead mounting plate adapted to be attached onto an overhead structural support;

a shelf having a motorized wind-up mechanism mounted thereon, said shelf including an upper platform and a base therebeneath, and said wind-up mechanism being disposed in an enclosed space in said shelf and including a pair of arbors which rotate under action of a motor, and locking means releasably locking said arbors against rotation;

first and second cables wound onto said arbors respectively and having upper ends attached to said mounting plate; and first and second scissors-action stabilizer linkages mounted respectively at left and right ends of said shelf and also at left and right ends of said overhead mounting plate; and wherein said arrangement is adapted to operate such that when a user actuates said motor to lower the shelf from a raised position thereof to a lowered position, the cables unwind from said arbors of said wind-up mechanism, said locking means locks said wind-up mechanism against rotation with the shelf in its lowered position, and said scissors-action stabilizer linkages stabilize said shelf against tipping and swinging; and when the user actuates a control for said motor to raise the shelf, a release mechanism on said locking means releases said wind-up mechanism, and said wind-up mechanism rewinds said cables onto said arbors to lift said shelf to its raised position.

11. A shelf arrangement according to claim 10 wherein the motor of said wind-up mechanism includes an electric motor operatively coupled to said arbors.

12. A shelf arrangement according to claim 10 wherein a control for said motor includes a hand-held controller depending from said shelf and coupled by a cord to said motor.

13. A shelf arrangement according to claim 1 further comprising a pair of sleeves constituted of a low friction material and fitted into said shelf, with said cables passing respectively therethrough.

14. A shelf arrangement according to claim 10 further comprising a pair of sleeves constituted of a low friction material and fitted into said shelf, with said cables passing respectively therethrough.

* * * * *